US007335841B2

(12) United States Patent
Ozawa et al.

(10) Patent No.: US 7,335,841 B2
(45) Date of Patent: Feb. 26, 2008

(54) BUTTON STRUCTURE FOR A TIMEPIECE AND A TIMEPIECE HAVING THIS BUTTON STRUCTURE

(75) Inventors: Noriaki Ozawa, Matsumoto (JP); Kimikazu Kawahara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/711,650

(22) Filed: Feb. 28, 2007

(65) Prior Publication Data

US 2007/0215442 A1 Sep. 20, 2007

(30) Foreign Application Priority Data

Mar. 15, 2006 (JP) ..... 2006-071645

(51) Int. Cl.
*H01H 9/20* (2006.01)
*H01H 9/24* (2006.01)
*H01H 9/26* (2006.01)

(52) U.S. Cl. ..... 200/50.36; 200/520; 200/341

(58) Field of Classification Search ..... 200/50.36
See application file for complete search history.

(56) References Cited

U.S. PATENT DOCUMENTS 6,137,750 A * 10/2000 Rieben ..... 368/290
6,846,998 B2 * 1/2005 Hasumi et al. ..... 200/341
6,872,899 B2 * 3/2005 Oshio et al. ..... 200/43.13
7,034,237 B2 * 4/2006 Ferri et al. ..... 200/341

FOREIGN PATENT DOCUMENTS

DE 3309321 A1 9/1984
EP 0426941 A1 5/1991
GB 2096831 A 10/1982
JP 2005-214795 A 8/2005

* cited by examiner

*Primary Examiner*—Elvin Enad
*Assistant Examiner*—Lheiren Mae A. Anglo
(74) *Attorney, Agent, or Firm*—Global IP Counselors, LLP

(57) ABSTRACT

A timepiece button structure has a base having a first cavity, a first button member, a second button member having a second cavity part, first and second urging members, and first and second movement-limiting members. The second button member is disposed to protrude from and recede into the first cavity part with the second urging member urging the second button member in the direction protruding from the first cavity part and the second movement-limiting member limiting movement in the protrusion direction. The first button member is disposed to protrude from and recede into the second cavity part with the first urging member urging the first button member in the direction protruding from the second cavity part and the first movement-limiting member limiting movement in the protrusion direction. The first button member moves alone in the receding direction until the first button member contacts the second button member when the first button member is pushed against the urging force of the first urging member in the direction receding into the second cavity part, and the first and second button members move together in the receding direction when the first button member is pushed further against the urging force of the first and second urging members in the direction receding into the first cavity part after the first button member contacts the second button member.

5 Claims, 6 Drawing Sheets

BUTTON STRUCTURE FOR A TIMEPIECE AND A TIMEPIECE HAVING THIS BUTTON STRUCTURE

BACKGROUND

1. Technical Field

The present invention relates to a button structure for a timepiece and to a timepiece having this button structure. More specifically, the invention relates to a button structure for a timepiece having a button member that is operated by being pushed into the case member of the timepiece, and to a timepiece having this button structure.

2. Related Art

The buttons on a timepiece are generally configured to implement one function by pressing the button, but switch mechanisms for implementing two functions using a single button are also available. See, for example, Japanese Unexamined Patent Appl. Pub. JP-A-2005-214795 (page 3 and FIG. 1).

This type of timepiece switch mechanism uses a mechanism enabling a two-stage operation but from the outside appears the same as a button that has only a single stage operation, and the functionality of the button is therefore not readily apparent to the user. The first time a user operates this switch mechanism, for example, and sees the pushbutton exposed on the outside of the timepiece case member, it is difficult to visually determine whether the pushbutton has a single-stage operating mechanism or a two-stage operating mechanism, and timepiece operability is thus reduced.

A button structure for a timepiece and a timepiece having this button structure according to a preferred aspect of the invention enables the user to easily know visually and mechanically that the button is a mechanism enabling two kinds of input, and offers excellent operability.

SUMMARY

A first aspect of the invention is a timepiece button structure including a base having a first cavity part, a first button member, a second button member having a second cavity part, first and second urging members, and first and second movement-limiting members, wherein the second button member is disposed to protrude from and recede into the first cavity part with the second urging member urging the second button member in the direction protruding from the first cavity part and the second movement-limiting member limiting movement in the protrusion direction, and the first button member is disposed to protrude from and recede into the second cavity part with the first urging member urging the first button member in the direction protruding from the second cavity part and the first movement-limiting member limiting movement in the protrusion direction. The first button member moves alone in the receding direction until the first button member contacts the second button member when the first button member is pushed against the urging force of the first urging member in the direction receding into the second cavity part, and the first and second button members move together in the receding direction when the first button member is pushed further against the urging force of the first and second urging members in the direction receding into the first cavity part after the first button member contacts the second button member.

The base can be rendered in unison with the case member of the timepiece, or as a member that is separate from the case member and can be fastened to the case member.

When the button members are in the protruding position the button members are at the ends of the ranges of movement allowed by the movement-limiting members in the direction (protrusion direction) in which the button members travel from the inside to the outside of the case member.

When the first button member is not depressed with this arrangement, the first button member is housed so that it can move in and out of the second cavity part while the first urging member urges the first button member in the protrusion direction and the first movement-limiting member limits movement in the protrusion direction. The top part of the first button member is therefore exposed to the outside protruding from the second cavity part.

The second button member is likewise housed so that it can move in and out of the first cavity part while the second urging member urges the second button member in the protrusion direction and the second movement-limiting member limits movement in the protrusion direction. The top part of the second button member is therefore exposed to the outside protruding from the first cavity part.

The user can therefore easily visually recognize that there are first and second button members that can move relative to the base and the button structure enables two types of input.

When the first button member is pushed in the depressing direction, the first button member moves alone and the second button member remains in the protruding position and does not move until the first button member contacts the second button member. The user can therefore easily recognize the stroke until the first button member contacts the second button member as a first depression stage.

When the first button member is moved further in the depressed direction after the first button member contacts the second button member, the first button member and the second button member move together. The user can therefore easily recognize the state in which the first button member and second button member move together as a second depression stage.

While there is thus only one button member that the user operates, the user can easily recognize both visually and mechanically that the button mechanism enables two kinds of input, and operability can be improved.

When the first button member is depressed, the first button member enters the second cavity part, and when the first button member and second button member are depressed together, the second button member enters the first cavity part. A shaft that communicates with the inside of the case member can therefore be disposed to only the first button member, two different inputs can be enabled by detecting the position to which the shaft has moved, and it is not necessary to render a shaft that communicates with the inside the case member to the second button member. A button mechanism that enables a two-stage input operation can therefore be rendered compactly similarly to a conventional button mechanism that enables only a single input. The button structure of this invention can therefore be disposed in the same space required by a button that enables only a single input.

In another aspect of the invention the urging force of the second urging member is less than the urging force of the first urging member.

The pressure needed to depress the first button member and second button member together is thus greater by an amount equal to the urging force of the second urging member than the pressure needed to depress the first button member from the protruding position to the second button member. If the urging force of the second urging member is greater than or equal to the urging force of the first urging member, for example, the amount of force required to depress the button members increases greatly approximately when the first button member contacts the second button member. The user may therefore find the operation of depressing the first button member and second button member together, that is, the second-stage input operation, difficult. By setting the urging force of the second urging member to less than the urging force of the first urging member, however, the increase in the force required when the first button member contacts the second button member is reduced, and the second-stage input operation is smooth.

The urging members can be coil springs or other type of flexible member.

In another aspect of the invention a portion of the side wall delimiting the first cavity part in the base is a guard portion that protrudes more than other parts of the side wall in the protrusion direction, and the height from the top of the guard portion to the bottom of the first cavity part is less than or equal to the height from the top of the first button member to the bottom of the first cavity part when the first button member touches the second button member in the protruding state, and is greater than the height from the top of the first button member to the bottom of the first cavity part when both the first and second button members are fully depressed into the first cavity part.

When the first button member is pushed from the first depression stage to the second depression stage with this arrangement, the first button member must be pushed below the height of the guard, and the user can easily differentiate the first depression stage and the second depression stage. Operating errors can also be prevented because accidentally pressing the first button member from the first depression stage to the second depression stage can be avoided.

In the timepiece button structure according to another aspect of the invention the base is separate from the case member of the timepiece.

By rendering the base discretely from the case member of the timepiece the case member can be produced as a simple shape that does not include the base portion when manufacturing the case member, and manufacturing is therefore simplified. The specifications of the button mechanism can also be changed without changing the shape of the case member.

Another aspect of the invention is a timepiece having the timepiece button structure of the invention.

This arrangement improves the operability of buttons disposed to the timepiece by using the timepiece button structure of the invention.

In addition, when a plurality of buttons are disposed to a timepiece, the single-action buttons that are conventionally provided in two locations can be combined at a single location. The number of buttons can therefore be reduced and the design of the timepiece can be improved.

A button structure for a timepiece and a timepiece having the button structure of this invention enables the user to easily visually recognize that the button mechanism enables two kinds of input, affords excellent operability, and enables locating a button enabling two types of input at one place on the timepiece.

Other objects and attainments together with a fuller understanding of the invention will become apparent and appreciated by referring to the following description and claims taken in conjunction with the accompanying drawings.

DESCRIPTION OF EXEMPLARY EMBODIMENTS

Figure 1:
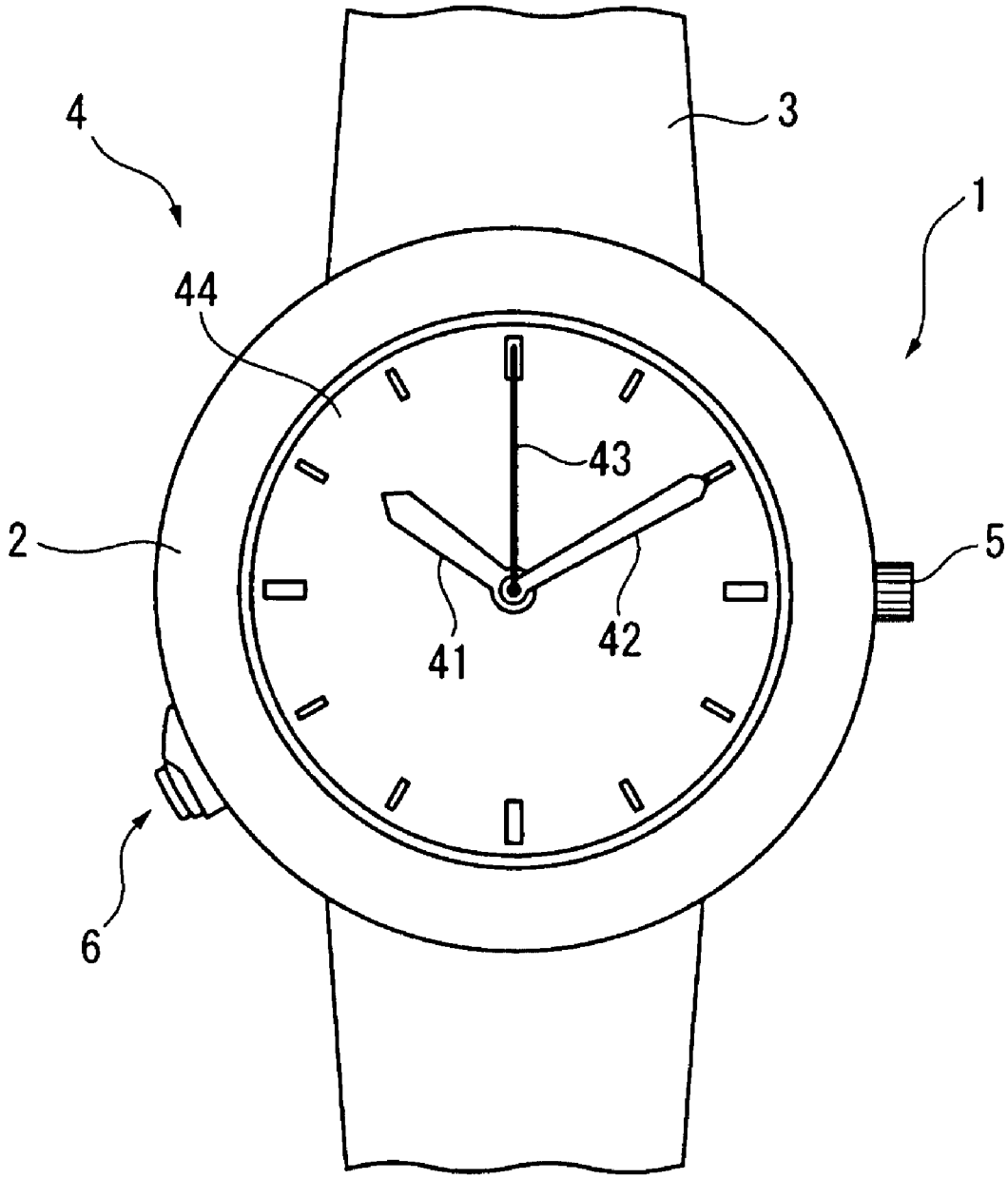
FIG. 1 is a plan view of a timepiece according to a preferred embodiment of the invention.

Preferred embodiments of the present invention are described below with reference to the accompanying figures wherein like parts are identified by the same reference numerals and further description of those parts is simplified or omitted.

As shown in FIG. 1, a timepiece 1 according to this embodiment of the invention is an analog timepiece that has a case member 2, a band 3 that is attached to the case member 2, and a time display unit 4 assembled inside the case member 2.

The time display unit 4 has hour, minute, and second hands 41, 42, and 43, and a dial 44.

A crown 5 is disposed to the case member 2 at the three o'clock position, and a button 6 is disposed at the eight o'clock position.

This button 6 is described in detail next with reference to FIG. 2 to FIG. 4.

Figure 2:
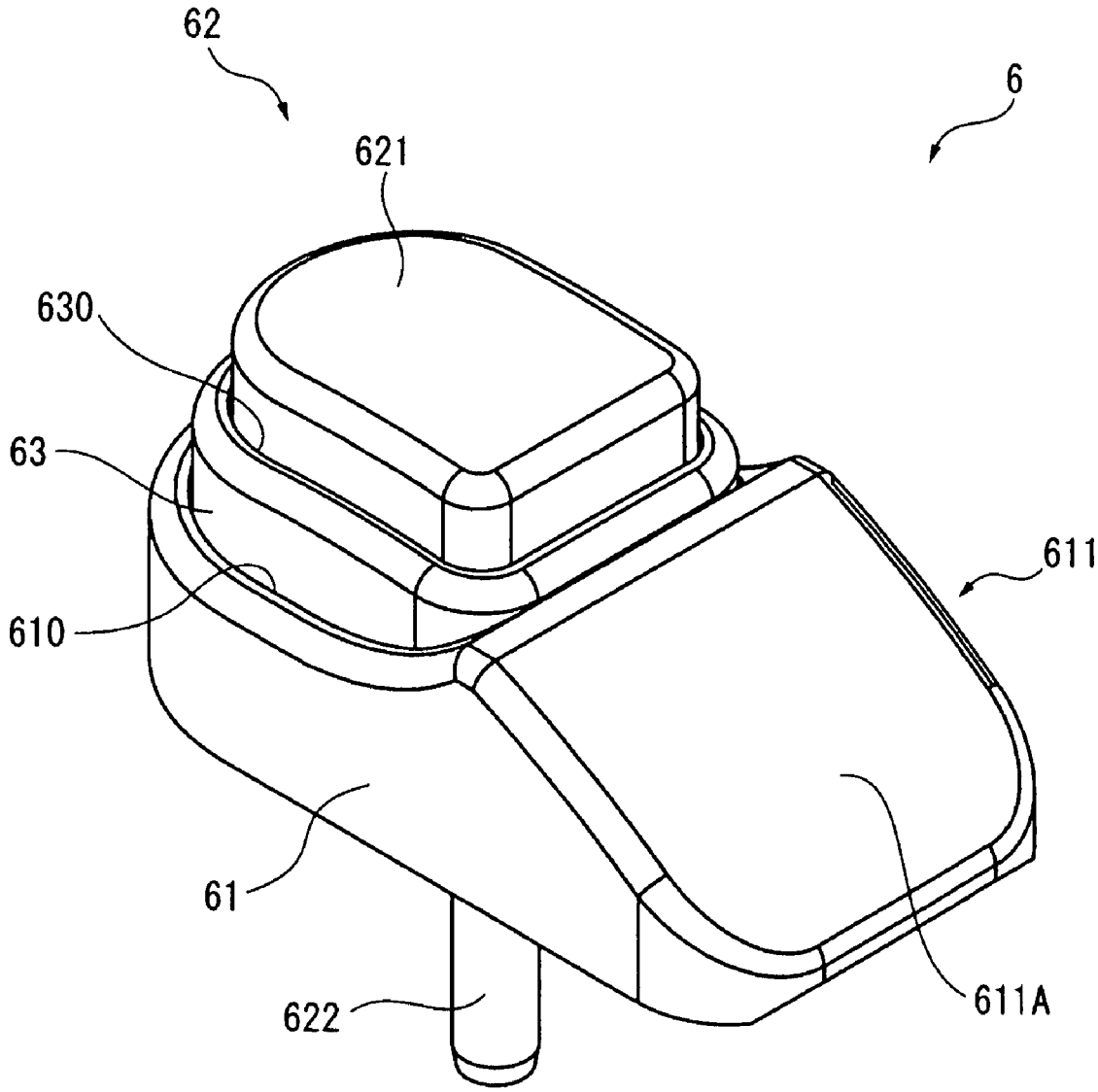
FIG. 2 is an oblique view of the button structure in this timepiece.
Figure 3:
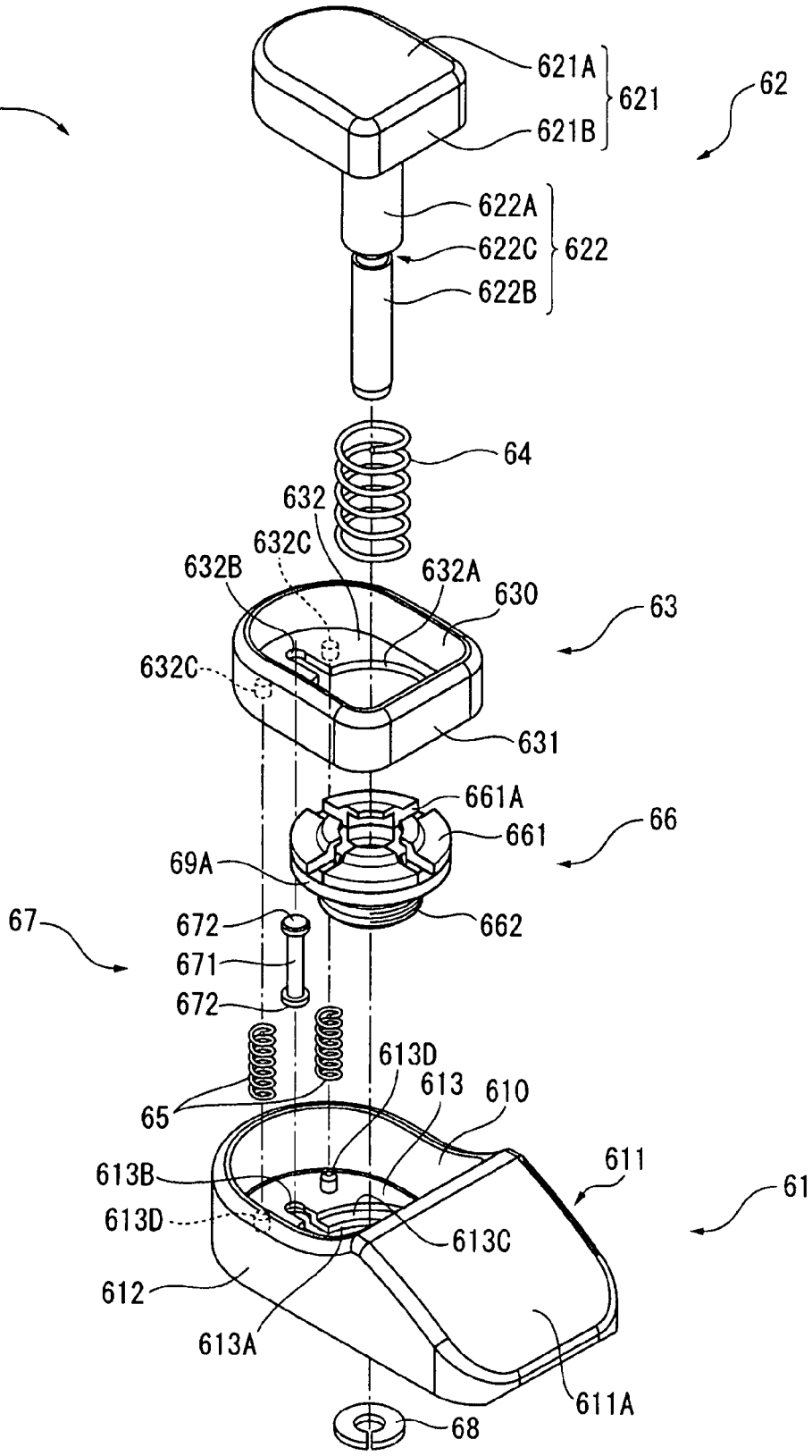
FIG. 3 is an exploded oblique view of the button structure.

As shown in FIG. 2 and FIG. 3 the button 6 has a button cover 61 as the base, a first button member 62, a second button member 63, a first coil spring 64 as a first urging member, a second coil springs 65 as a second urging member, a fastening member 66, a limiting member 67 as a second movement limiting means, and a C-ring 68 as a first movement limiting means.

A first cavity 610 is formed in the button cover 61.

As shown in FIG. 3 the first cavity 610 is delimited by a guard 611, a side wall 612, and a bottom 613. When seen in plan view the shape of the inside wall of the first cavity 610 is substantially identical to the shape of the outside of the second button member 63 described below. In other words, the guard 611 and the side wall 612 are disposed to conform to the shape of the outside side wall of the second button member 63. The first cavity 610 is thus shaped to hold the second button member 63 inside the first cavity 610.

Figure 4:
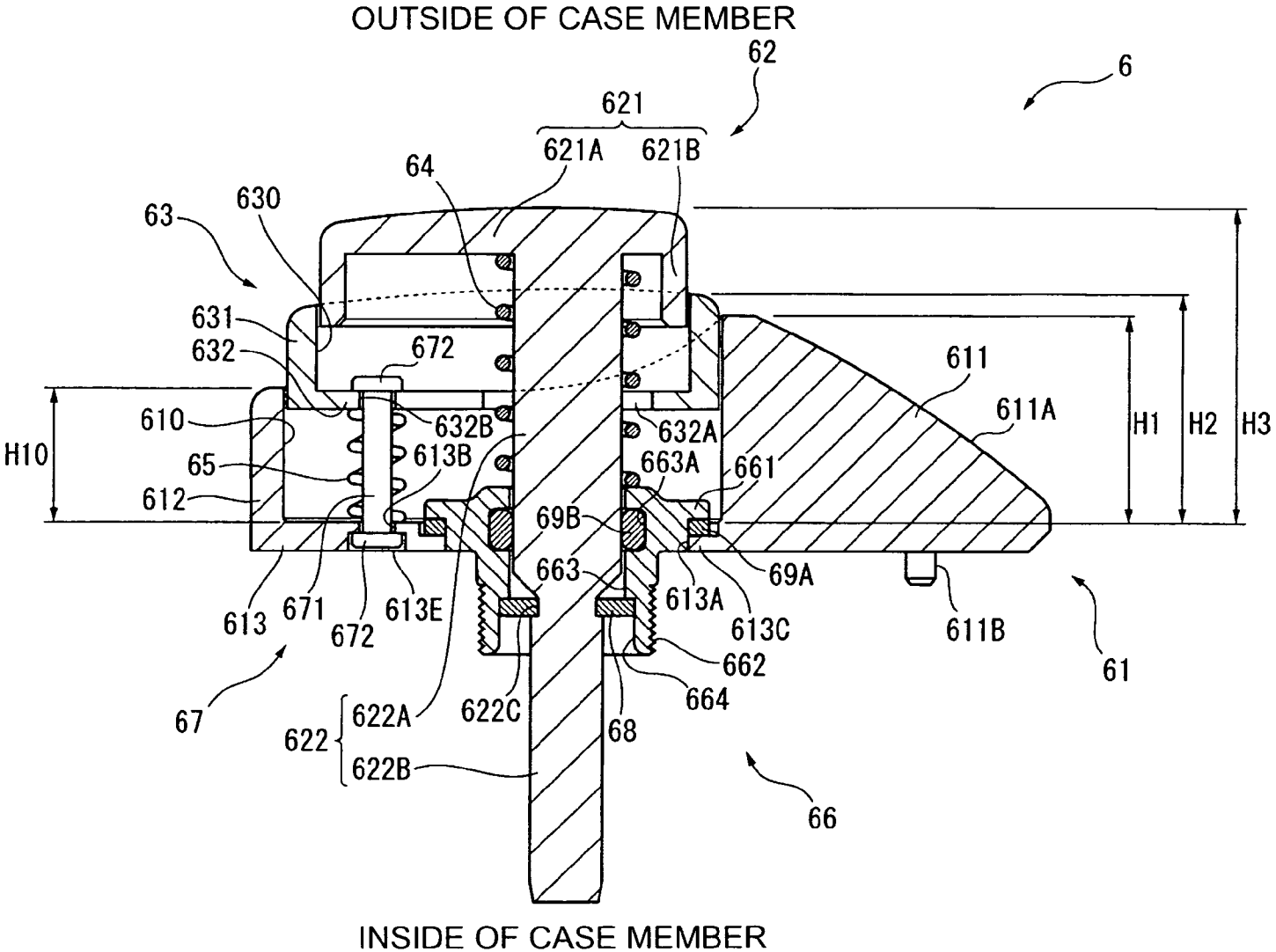
FIG. 4 is a vertical section view of the button structure.

The guard 611 has an inclined surface 611A so that the guard 611 is shaped substantially like a right triangle when seen in a side section as shown in FIG. 4. The height H1 from the bottom of the first cavity 610 to the top of the side wall of the guard 611 facing the first cavity 610 is greater than the height H10 from the bottom of the first cavity 610 to the top of the other parts of the side wall 612. The guard 611 that is also a part of the side wall delimiting the first cavity 610 is thus shaped to protrude more in the protrusion direction (the direction moving from the inside to the outside of the case member 2) than the other parts of the side wall 612 of the first cavity 610.

A rotation prevention unit 611B is also disposed protruding from the bottom of the guard 611. This rotation prevention unit 611B fits into a recess not shown rendered in the case member 2.

A circular opening 613A and a slot 613B are formed in the bottom 613 as shown in FIG. 3. An engaging recess 613E that has a larger inside diameter than the width of the slot 613B is formed at the end of the slot 613B in the surface facing the case member 2 (that is, the bottom of the button cover 61). The end flange 672 of a limiting member 67 described below can thus engage this engaging recess 613E.

Two studs 613D are formed on the bottom 613. Each of the second coil springs 65 described below is fit onto one of these studs 613D.

The first button member 62 has ahead portion 621 and a shaft portion 622 as shown in FIG. 3.

The head portion 621 has a top part 621A and side wall 621B. As shown in FIG. 4, the head portion 621 is disposed so that the part of the side wall 621B towards the button cover 61 is inside a second cavity 630.

The shaft portion 622 as shown in FIG. 3 has a large diameter part 622A and a small diameter part 622B. The large diameter part 622A extends from the head portion 621 towards the case member 2. The small diameter part 622B further extends from the distal end of the large diameter part 622A towards the case member 2. A channel 622C is formed where the large diameter part 622A and small diameter part 622B meet. This channel 622C is rendered perpendicularly to the axis of the shaft portion 622 and around the entire circumference of the shaft portion 622. A C-ring 68 is disposed in the channel 622C.

The second cavity 630 is formed in the second button member 63.

As shown in FIG. 3, the second cavity 630 is delimited by a side wall 631 and a bottom 632. The shape of the inside side wall of the second cavity 630 is substantially the same as the shape of the outside side wall of the head portion 621 of the first button member 62 when seen in plan view. The second cavity is thus shaped to hold the first button member 62 inside the second cavity.

A round opening 632A and a slot 632B are formed in the bottom 632. The inside diameter of the round opening 632A is greater than the outside diameter of the first coil spring 64 further described below. The end flange 672 of the limiting member 67 described below engages the slot 632B.

Two studs 632C are disposed on the underside of the bottom 632. The other end of each of the second coil springs 65 described below is fit onto one of these studs 632C.

The shaft portion 622 of the first button member 62 is inserted through the first coil spring 64 so that the first coil spring 64 is between the head portion 621 of the first button member 62 and a fastening member 66 and the first coil spring 64 urges the first button member 62 in the protrusion direction.

There are two second coil springs 65 each disposed with one end engaging the bottom studs 613D and the other end engaging the top studs 632C so that the second coil springs 65 are disposed between the bottom 632 of the second button member 63 and the top surface of the bottom 613 of the button cover 61 and urge the second button member 63 in the protrusion direction.

When the first button member 62 is thus urged by the second coil springs 65 and is in the protruding position, a portion of the second button member 63 is held inside the first cavity 610.

The combined urging force of the two second coil springs 65 is less than the urging force of the first coil spring 64.

The second coil springs 65 are disposed eccentrically to the center of the second button member 63 when seen in plan view. More specifically, the second coil springs 65 are disposed on the opposite side of the plan view center of the second button member 63 as the side wall 631 that is beside the guard 611.

The fastening member 66 is basically cylindrically shaped and has a flange part 661 and a male threaded part 662.

A cross-shaped slotted channel 661A is formed in the flange part 661 to accept a screwdriver or similar tool. The outside diameter of the flange part 661 is greater than the inside diameter of the circular opening 613A in the button cover 61.

The male threaded part 662 is shaped so that it can be inserted through the circular opening 613A in the button cover 61. The male threaded part 662 can be screwed into a female thread rendered in the case member 2.

The fastening member 66 is disposed holding the inside flange 613C of the button cover 61 between the flange part 661 of the fastening member 66 and the case member 2, and thereby fastens the button cover 61 to the case member 2.

As shown in FIG. 4 a through-hole 663 is formed in the fastening member 66. The through-hole 663 is rendered so that the shaft portion 622 (the large diameter part 622A) of the first button member 62 can be inserted to this through-hole 663. A seal channel 663A for holding an annular seal member 69B is formed in the inside circumference surface of the through-hole 663. A recess 664 with an inside diameter greater than the inside diameter of the through-hole 663 is formed in the case member 2 end part of the through-hole 663. The C-ring 68 engages the shoulder rendered by this recess 664.

The limiting member 67 has two circular end flanges 672 and a columnar connecting portion 671 joining the end flanges 672. The outside diameter of the end flanges 672 is greater than the width of the slot 613B in the button cover 61 and the slot 632B in the second button member 63. The connecting portion 671 is sized so that the connecting portion 671 can be inserted to the slots 613B and 632B.

The limiting member 67 is thus disposed so that the one end flange 672 engages the slot 613B in the button cover 61, the other end flange 672 engages the slot 632B in the second button member 63, and the limiting member 67 thereby limits movement of the second button member 63 beyond a predetermined position in the protrusion direction. Note that when the second button member 63 is in the protruding position the second button member 63 is positioned where further movement in the protruding direction is prevented by the limiting member 67. Furthermore, when the second button member 63 is urged by the second coil springs 65 to the position where further movement is limited by the limiting member 67 and the second button member 63 is thus in the protruding position, the top part of the second button member 63 protrudes from the first cavity 610 while the bottom part of the second button member 63 is held inside the first cavity 610.

The outside diameter of the C-ring 68 is greater than the outside diameter of the large diameter part 622A of the first button member 62. The C-ring 68 is fit into the channel 622C in the first button member 62.

The C-ring 68 is disposed in contact with the shoulder where the recess 664 meets the through-hole 663 of the fastening member 66 so that the first button member 62 cannot move beyond a predetermined position in the protrusion direction. When the first button member 62 is protruding, the first button member 62 is positioned where further movement in the protrusion direction is prevented by the C-ring 68. When the first button member 62 is thus urged by the first coil spring 64 to the position limited by the C-ring 68 so that the first button member 62 is protruding, the top part of the first button member 62 projects from the second cavity 630 and the bottom part of the first button member 62 is held inside the second cavity 630.

Figure 5:
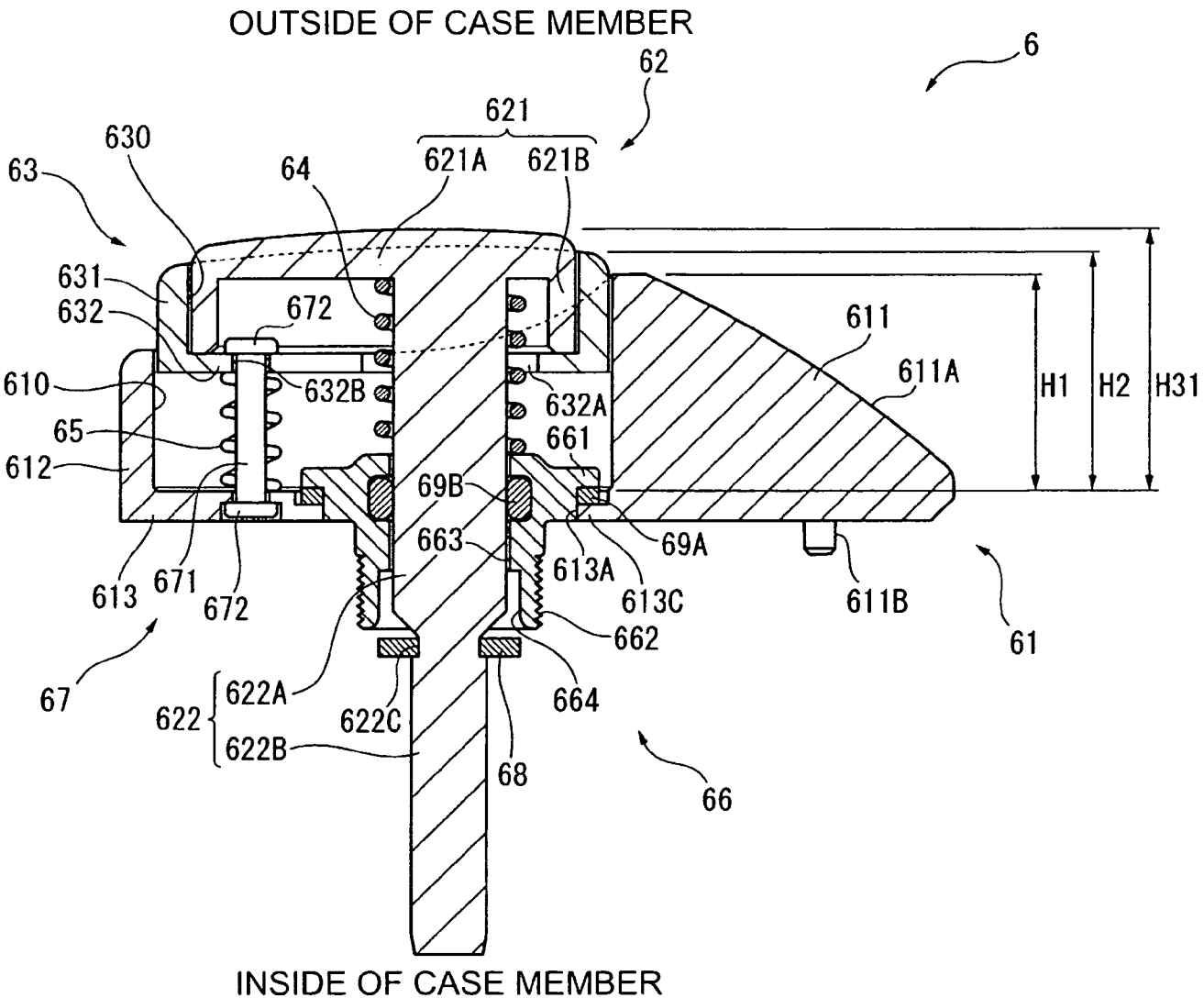
FIG. 5 is a vertical section view showing the button depressed to a first operating position.

The first button member 62 is disposed so that it contacts the second button member 63 when the first button member 62 is depressed from the protruding position as shown in FIG. 5. More specifically, the side wall 621B of the head portion 621 of the 6222 contacts the bottom 632 of the second button member 63. Because there are no common points of contact between the first button member 62 and the second button member 63 until the first button member 62 descends and touches the second button member 63, the first button member 62 moves independently of the second button member 63 until contact is made with the second button member 63.

The stroke of the first button member 62 from the protruding position to where the first button member 62 contacts the second button member 63 is referred to as a first depression stage, and the position of the shaft portion 622 of the first button member 62 inside the case member 2 at the end of the first depression stage is the first input position.

When the first button member 62 is depressed further from where the first button member 62 contacts the second button member 63, the first button member 62 and the second button member 63 move together.

When any of the first and second coil springs 64 or 65 is fully compressed, the first and second button members 62 and 63 have reached the end of the descending stroke and are in the fully depressed position.

The stroke of the first button member 62 from where the first button member 62 contacts the second button member 63 to this fully depressed position is referred to as a second depression stage, and the position of the shaft portion 622 of the first button member 62 inside the case member 2 at the end of the second depression stage is the second input position.

When the second button member 63 descends, the side wall 631 part of the second button member 63 facing the guard 611 slides along the side of the guard 611 so that the second button member 63 does not tilt and slides smoothly.

The protruding height H1 (see FIG. 4) of the button cover 61 from the bottom 613 of the first cavity 610 in the guard 611 is described next.

The height H1 of the button cover guard 611 is less than the height H2 of the second button member 63 from the bottom 613 of the first cavity 610 when the second button member 63 is in the normal protruding position.

The height H1 of the button cover guard 611 is also less than the height H31 (see FIG. 5) of the first button member 62 when the first button member 62 contacts the second button member 63 and the second button member 63 is in the normal protruding position.

The height H1 of the button cover guard 611 is greater than the protruding height H32 (see FIG. 6) of the first button member 62 when the first button member 62 is fully depressed.

The height H2 of the second button member 63 in the protruding position is less than the height H31 (see FIG. 5) of the first button member 62 when the first button member 62 contacts the second button member 63 and the second button member 63 is in the normal protruding position.

Assembling this button 6 and installing the button 6 to the case member 2 is described next with reference to FIG. 3 and FIG. 4.

One end flange 672 of the limiting member 67 is first inserted to the slot 613B in the button cover 61.

The button cover 61 is then set to the installation position on the case member 2 (near the eight o'clock position in this embodiment). The rotation prevention unit 611B of the button cover 61 is inserted to a corresponding positioning recess (not shown) in the case member 2 to position the button cover 61.

The fastening member 66 is then inserted to the opening 613A from the first cavity 610 side of the button cover 61, a screwdriver or other tool is inserted to the slotted channel 661A in the fastening member 66, and the fastening member 66 is then turned to screw the male threaded part 662 of the fastening member 66 into the female thread in the case member 2. The inside flange 613C of the button cover 61 is thus disposed between the flange part 661 of the fastening member 66 and the case member 2, and the button cover 61 is fastened to the case member 2. Note that inserting the rotation prevention unit 611B of the button cover 61 into the recess in the case member 2 prevents the button cover 61 from rotating when being secured.

The second button member 63 is then placed into the first cavity 610 while positioning the two second coil springs 65 between the button cover 61 and second button member 63. The free end flange 672 of the limiting member 67 is then inserted to the slot 632B in the second button member 63. The ends of the second coil springs 65 are also fit onto the studs 613D of the button cover 61 and the studs 632C of the second button member 63 to prevent the springs from shifting position or falling out.

The shaft portion 622 of the first button member 62 is inserted to the first coil spring 64, and the shaft portion 622 and first coil spring 64 are inserted through the opening 632A in the second button member 63 and the through-hole 663 in the fastening member 66 so that the distal end of the shaft portion 622 is inside the case member 2.

The C-ring 68 is then fit into the channel 622C of the shaft portion 622 so that the shaft portion 622 does not separate from the fastening member 66.

This completes both assembling and fastening the button 6 to the case member 2.

Operation of the button 6 is described next with reference to FIG. 4 to FIG. 6.

As shown in FIG. 4, when the first button member 62 moves from the protruding position to the depressed position, the first button member 62 descends while compressing the first coil spring 64 until the first button member 62 contacts the second button member 63. The second button member 63 does not move until the head portion 621 of the first button member 62 touches the bottom 632 of the second button member 63 because there are no other parts of the first button member 62 and the second button member 63 that touch. This operation results in a first input operation because the first input position is set between the free protruding position of the first button member 62 and where the first button member 62 contacts the second button member 63.

Figure 6:
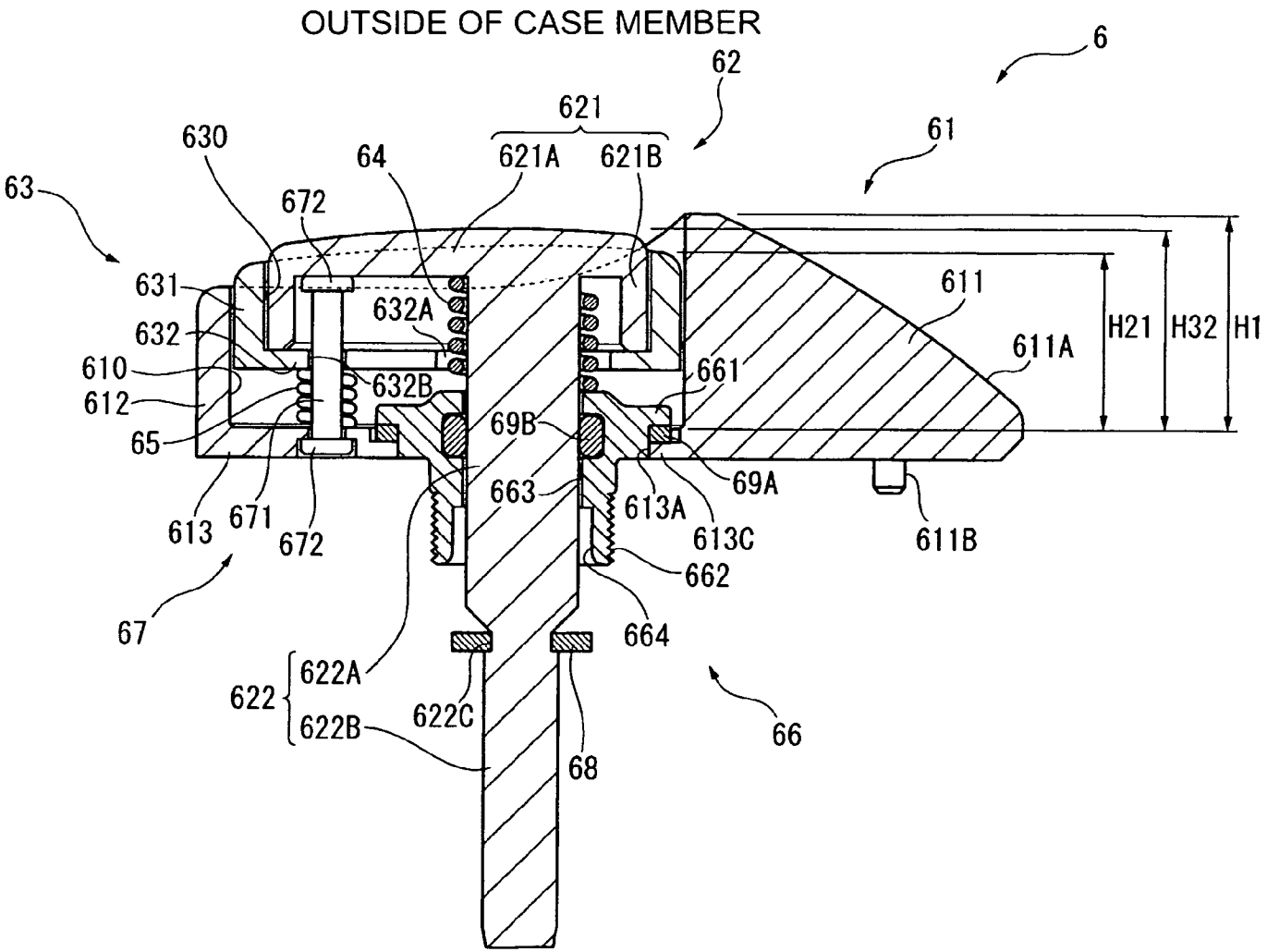
FIG. 6 is a vertical section view showing the button depressed to a second operating position.

When the first button member 62 is further depressed, the first button member 62 and the second button member 63 move together to the fully depressed position of the first button member as shown in FIG. 6. This operation results in a second input operation because the second input position is set between where the first button member 62 contacts the second button member 63 and where the first button member reaches the fully depressed position.

This embodiment of the invention thus enables two input operations by differentiating the operation that moves only the first button member 62 and the operation that moves both the first and second button members 62 and 63.

The effect of this aspect of the invention is described below.

(1) The user can easily ascertain that the button enables two input operations because the first and second button members 62 and 63 are disposed protruding in two stages from the button cover 61.

Furthermore, because the second button member 63 does not move when the first button member 62 is depressed to the first depression stage and only the first button member 62 descends into the second cavity 630, the user can also easily visually and mechanically determine that the first button member 62 is at the first depression stage.

Furthermore, because the first button member 62 and the second button member 63 move together and the second button member 63 recedes into the first cavity 610 when the first button member 62 is depressed to the second depression stage, the user can also easily visually and mechanically determine that the button has been depressed to the second depression stage.

The user can therefore easily visually and mechanically know that the button structure enables two types of input, and operability can be improved.

(2) The size of the button structure is substantially the same as a single-input button structure because the first button member 62 is inside the second cavity 630 at the first depression stage and the second button member 63 is inside the first cavity 610 at the second depression stage, and less space is therefore needed for the buttons on the case member 2 when compared with using two single-input buttons. While a timepiece 1 having four input functions conventionally requires buttons in four locations, for example, the invention halves this to two locations, thereby reducing the space occupied by buttons and improving the aesthetic design of the timepiece 1.

(3) The combined urging force of the two second coil springs 65 is less than the urging force of the first coil spring 64, thus reducing the additional force needed to depress the button from the first depression stage to the second depression stage, enabling a smooth button operation, and improving operability.

(4) When the first button member 62 is depressed from the first depression stage to the second depression stage the user can easily differentiate between the first depression stage and the second depression stage because the guard 611 is provided and the first button member 62 must be pushed below the top of the guard 611. Accidentally pushing the first button member 62 from the first depression stage to the second depression stage can thus be avoided, and operating errors can therefore also be avoided.

(5) The case member 2 can be manufactured by producing a case member 2 with a simple shape not including the button cover 61 because the button cover 61 is separate from the case member 2. The manufacturing process (finishing process) can therefore be simplified and button 6 assembly can also be simplified. The button design can also be changed without affecting the shape of the case member 2.

(6) The second button member 63 can move smoothly without tilting because the side wall 631 of the second button member 63 facing the guard 611 slides along the side of the guard 611 even if the second coil springs 65 that urge the second button member 63 are offset from the center of the second button member 63 because the height H1 that the guard 611 protrudes is greater than the height H10 of the side wall 612 of the button cover 61.

The invention is not limited to the embodiment described above and can be modified and improved in many ways without departing from the scope of the accompanying claims.

For example, the button cover 61 that is the base of the button structure is separate from the case member 2 in this preferred embodiment of the invention, but the base member of the button structure can be rendered in unison with the case member.

This embodiment also has a guard 611 disposed to the button cover 61, but the side walls 612 can be rendered to the same height and the guard 611 can be omitted.

Furthermore, the location and number of the guards is not limited to this embodiment of the invention when the guard 611 is provided. For example, a guard 611 can also be rendered on the opposite side of the first cavity 610 as the guard 611 in this embodiment.

The guard 611 has an inclined surface 611A and is rendered with a substantially right triangle shape when seen in a side section, but the inclined surface 611A can be omitted and the guard 611 can be shaped identically to the side wall 612. If the inclined surface 611A is provided, however, the operating feel of the button 6 can be improved because the finger that pushes the button 6 can rest on the inclined surface 611A.

The urging force of the second coil springs 65 is less than the urging force of the first coil spring 64 in this embodiment, but these urging forces can be the same or the urging force of the second coil springs 65 can be greater than the urging force of the first coil spring 64.

Coil springs are used as the urging members in this embodiment, but the button member can be urged by an urging member other than a coil spring, such as a flexible rubber member or a flat spring, or an urging means that uses magnetism, for example.

The limiting means is not limited to the limiting member 67 and C-ring 68, and can be any means that can limit movement of the button members 62 and 63.

The best modes and methods of achieving the present invention are described above, but the invention is not limited to these embodiments. More specifically, the invention is particularly shown in the figures and described herein with reference to specific embodiments, but it will be obvious to one with ordinary skill in the related art that the shape, material, number, and other detailed aspects of these arrangements can be varied in many ways without departing from the technical concept or the scope of the object of this invention.

Therefore, description of specific shapes, materials and other aspects of the foregoing embodiments are used by way of example only to facilitate understanding the present invention and in no way limit the scope of this invention, and descriptions using names of parts removing part or all of the limitations relating to the form, material, or other aspects of these embodiments are also included in the scope of this invention.

The entire disclosure of Japanese Patent Application No. 2006-071645, filed Mar. 15, 2006 is expressly incorporated by reference herein.

What is claimed is:

1. A timepiece button structure comprising a base having a first cavity part; a first button member; a second button member having a second cavity part; first and second urging members; and first and second movement-limiting members, wherein:

the second button member is disposed to protrude from and recede into the first cavity part with the second urging member urging the second button member in the direction protruding from the first cavity part and the second movement-limiting member limiting movement in the protrusion direction;

the first button member is disposed to protrude from and recede into the second cavity part with the first urging member urging the first button member in the direction protruding from the second cavity part and the first movement-limiting member limiting movement in the protrusion direction;

the first button member moves alone in the receding direction until the first button member contacts the second button member when the first button member is pushed against the urging force of the first urging member in the direction receding into the second cavity part; and the first and second button members move together in the receding direction when the first button member is pushed further against the urging force of the first and second urging members in the direction receding into the first cavity part after the first button member contacts the second button member.

2. The timepiece button structure described in claim 1, wherein:

the urging force of the second urging member is less than the urging force of the first urging member.

3. The timepiece button structure described in claim 1, wherein:

a portion of a side wall delimiting the first cavity part in the base is a guard portion that protrudes more than other parts of the side wall in the protrusion direction; and the height from the top of the guard portion to the bottom of the first cavity part is less than or equal to the height from the top of the first button member to the bottom of the first cavity part when the first button member touches the second button member in the protruding state, and is greater than the height from the top of the first button member to the bottom of the first cavity part when both the first and second button members are fully recessed into the first cavity part.

4. The timepiece button structure described in claim 1, wherein the base is separate from a case member of a timepiece.

5. A timepiece comprising the timepiece button structure described in claim 1.

* * * * *